US011622619B2

(12) United States Patent
Pernet et al.

(10) Patent No.: US 11,622,619 B2
(45) Date of Patent: Apr. 11, 2023

(54) EXTENSIBLE TABLE WITH CENTRAL LEAF

(71) Applicant: LAFUMA MOBILIER SAS, Anneyron (FR)

(72) Inventors: Jean-Noël Pernet, Condamine la Doye (FR); Corrado Roani, Manthes (FR)

(73) Assignee: LAFUMA MOBILIER SAS, Anneyron (FR)

( * ) Notice: Subject to any disclaimer, the term of this patent is extended or adjusted under 35 U.S.C. 154(b) by 0 days.

(21) Appl. No.: 17/521,253

(22) Filed: Nov. 8, 2021

(65) Prior Publication Data

US 2022/0142352 A1 May 12, 2022

(30) Foreign Application Priority Data

Nov. 10, 2020 (FR) ..... 20/11555

(51) Int. Cl.
*A47B 1/02* (2006.01)

(52) U.S. Cl.
CPC ..... *A47B 1/02* (2013.01); *A47B 2001/025* (2013.01)

(58) Field of Classification Search
CPC ..... A47B 1/02; A47B 2001/025
USPC ..... 108/89
See application file for complete search history.

(56) References Cited

U.S. PATENT DOCUMENTS 265,864 A * 10/1882 Ralston ..... A47B 1/02 108/86
569,059 A * 10/1896 Roberts ..... A47B 1/02 108/85
5,735,220 A * 4/1998 Wang ..... A47B 1/10 108/87
7,454,875 B2 * 11/2008 Pervan ..... E04F 15/02038 52/586.2

(Continued)

FOREIGN PATENT DOCUMENTS

EP 3207824 B1 8/2017
FR 1568723 A 5/1969

(Continued)

OTHER PUBLICATIONS

Andy Rae, Tongue-and-Groove, Nov. 2016, Woodcraft Magazine, Issue 73, pp. 60-63 (Year: 2016).*

(Continued)

*Primary Examiner* — Daniel J Troy
*Assistant Examiner* — Timothy M Ayres
(74) *Attorney, Agent, or Firm* — Cantor Colburn LLP

(57) ABSTRACT

A table with a central extension, includes a frame, two movable trays bearing on the frame and adapted to be brought close to one another to constitute a continuous surface on their own, or to be symmetrically brought away from each other, or independently of each other to enable the set-up of one or several so-called central extension(s) between the movable trays. The edges of the movable trays and of the extension(s) include at least one tab located on a first half of the edge and a groove located on a second half (Continued)

of the edge, the tab having a height increasing from its distal edge up to its central portion and decreasing from its central portion up to its proximal edge, and the depth of the groove being larger than the tab height, enabling an assembly by mortise-and-tenon joint even when the trays and/or the extension are deformed.

8 Claims, 3 Drawing Sheets

(56) References Cited

U.S. PATENT DOCUMENTS

| | | | | |
|---|---|---|---|---|
| 9,622,568 | B1 * | 4/2017 | Lin | A47B 1/04 |
| 2005/0199162 | A1 | 9/2005 | Hendricks et al. | |
| 2006/0124037 | A1 * | 6/2006 | Conley | A47B 1/02 108/83 |

FOREIGN PATENT DOCUMENTS

| | | | |
|---|---|---|---|
| FR | 2261726 | A1 | 9/1975 |
| WO | 2011069956 | A1 | 6/2011 |

OTHER PUBLICATIONS

Wood Magazine Staff, Rule of thumb for mortise-and-tenon size, Apr. 2019, woodmagazine, https://www.woodmagazine.com/woodworking-how-to/joinery/mortise-tenon-joinery/rule-of-thumb-for-mortise-and-tenon-size (Year: 2019).*

* cited by examiner

[Fig. 1]
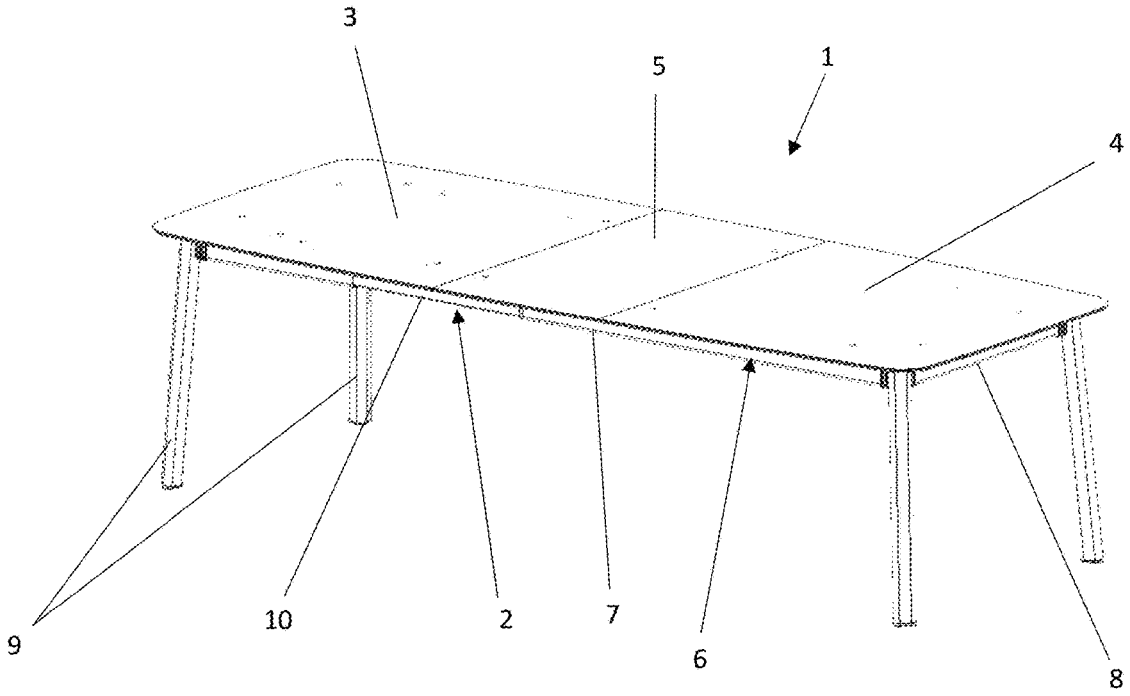
[Fig. 2]
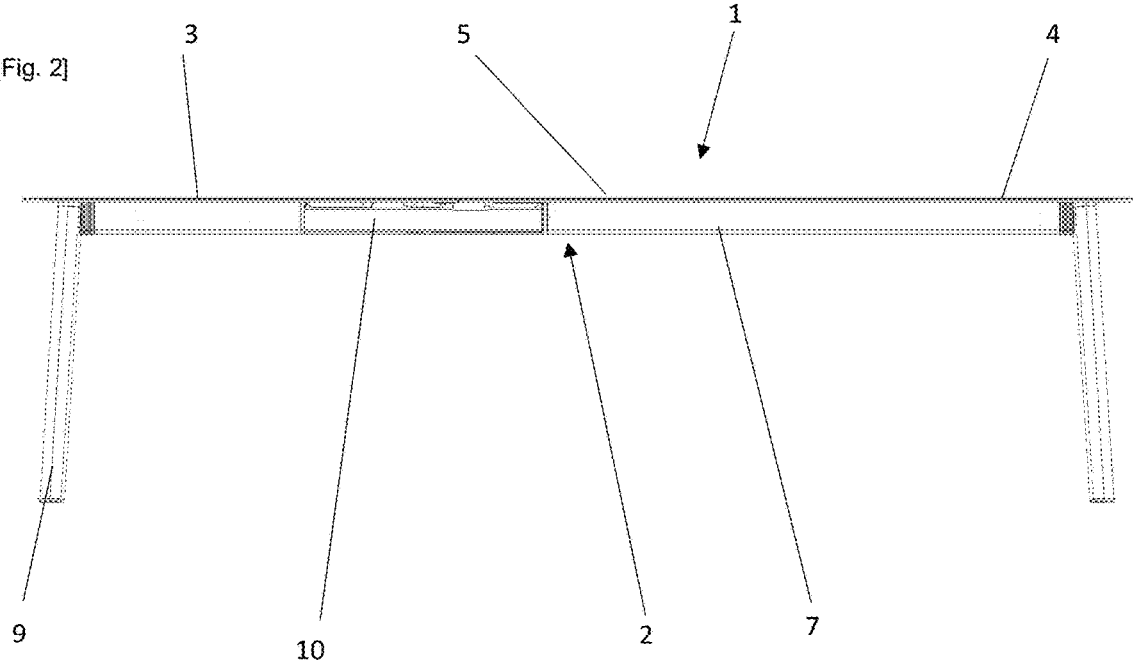

[Fig. 3]
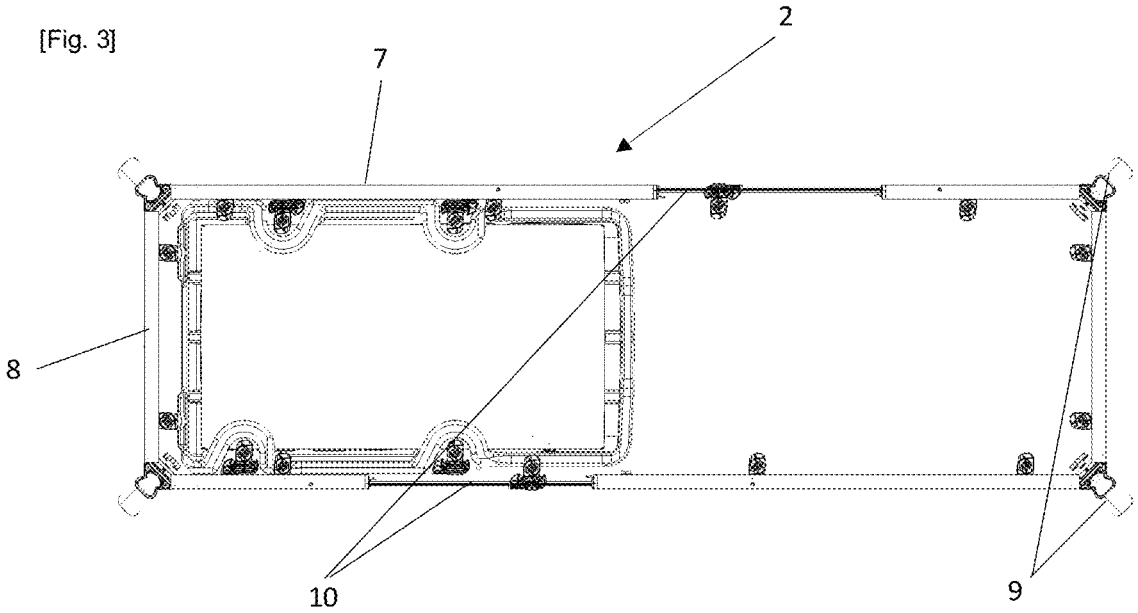
[Fig. 4]
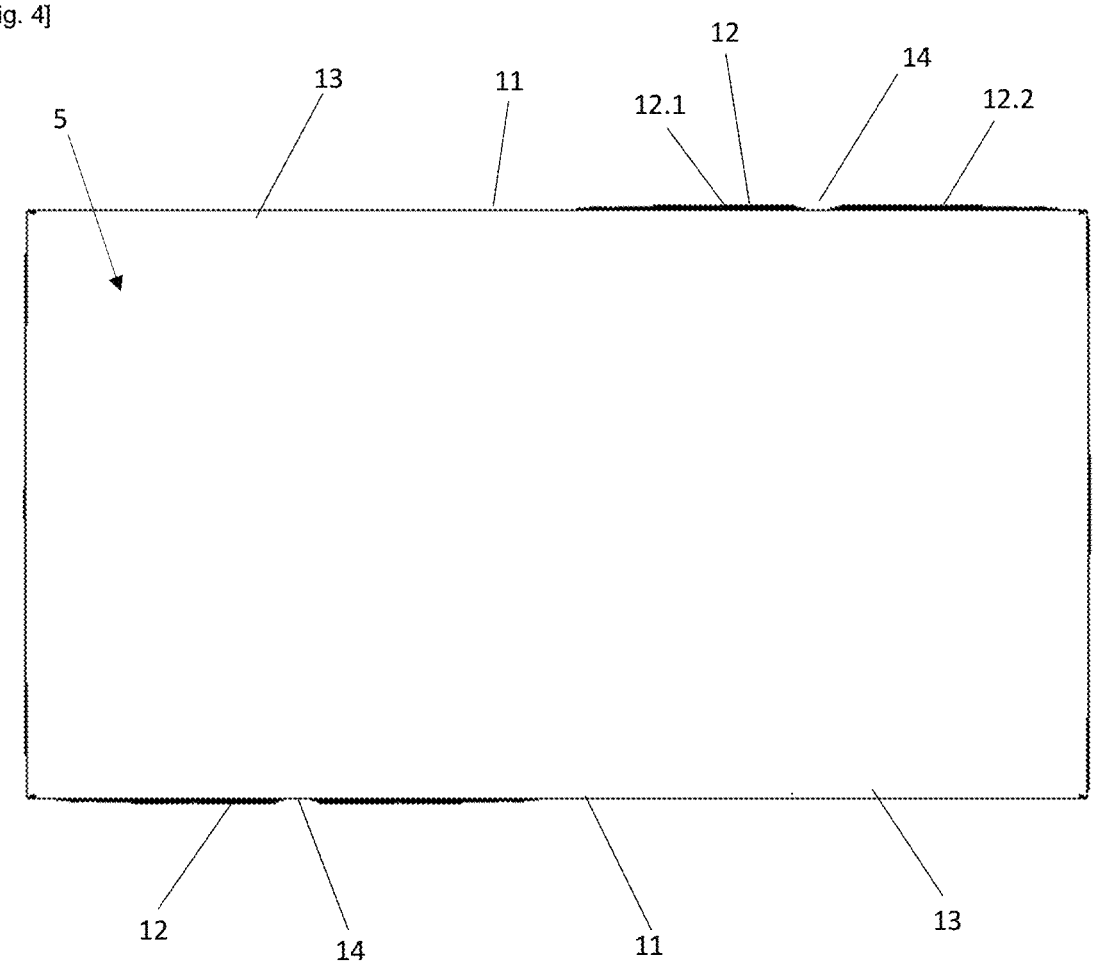

[Fig. 5]
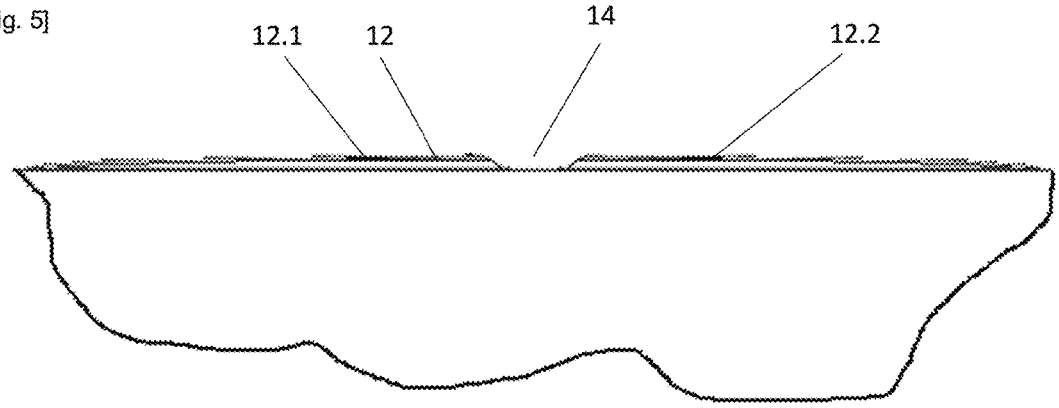
[Fig. 6]
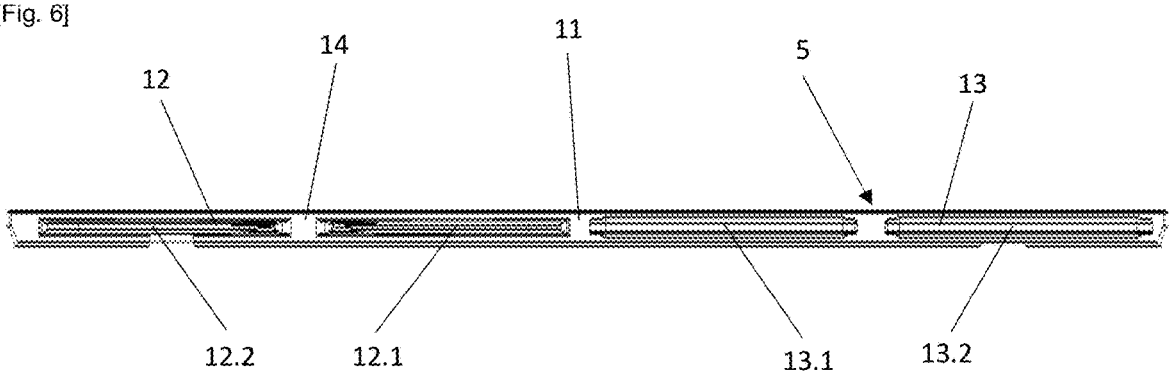
[Fig. 7]
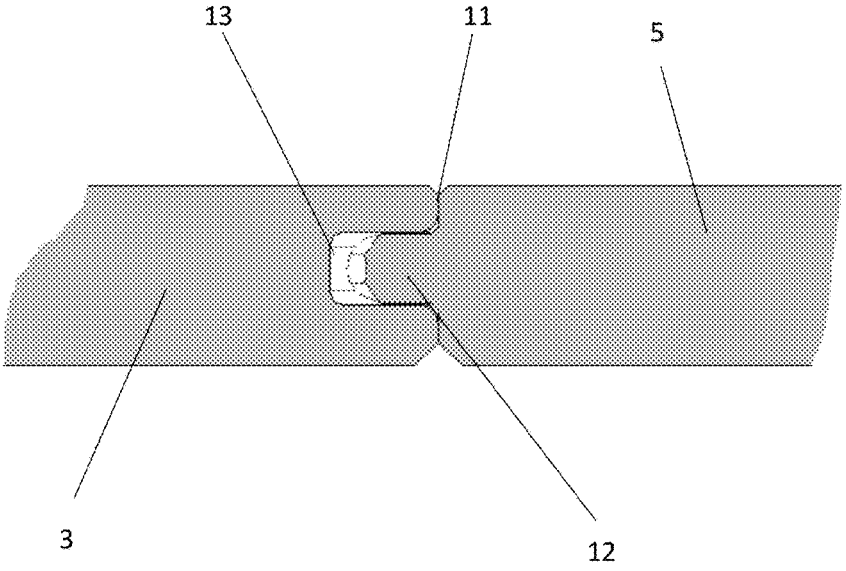

EXTENSIBLE TABLE WITH CENTRAL LEAF

CROSS REFERENCE TO RELATED APPLICATIONS

This application is related to and claims the benefit of French Patent Application No. 20/11555, filed on Nov. 10, 2020, the contents of which are herein incorporated by reference in their entirety.

TECHNICAL FIELD

The present disclosure concerns the field of tables with central extension of the type comprising a frame, two lateral trays at least one of which is mounted movable relative to said frame, and at least one central extension adapted to be positioned between the lateral trays, and more particularly of the tab-groove type by mortise-and-tenon joining of the extension with the lateral trays.

BACKGROUND

In the furniture field, and more particularly in the field of tables, it is well known to make transformable tables whose length, and consequently, whose surface, could be increased or reduced at will thanks to removable or stowable extensions.

The main known tables with extension include so-called Italian-type tables, with two extensions that could be stowed under the tray of the table or brought in the continuation of the two ends of this tray, and tables with central extension, comprising above a frame two movable trays adapted to be brought close to one another so as to constitute a continuous surface on their own, or to be symmetrically brought away from each other, or independently of each other, so as to enable the set-up of the central extension therebetween.

Such tables are described in particular in the documents FR2261726 and FR1568723.

The document FR2261726 describes a table with extension, rectangular, square-shaped or at least having the two lateral sides rectilinear, parallel and identical, wherein all of the elements constituting it are integral with the support of the table, characterized in that the two lateral sides of the support have a height at least equal to the height of the two main shelves plus the height of the extension shelf of the table, each of these two sides including at its lower face at least one rectilinear longitudinal guideway or notch as well as at least two vertical guideways or notches placed parallel to one another in an inverted L-like shape, the length of the vertical branch of this L being at least equal to the height of the or of both main shel(f/ves), the or both main shel(f/ves), as well as the extension shelf, being provided laterally with protruding elements such as pivots, teeth or ridges, that could allow displacing said shelves in the guideways, the dimension of which elements depends on these guideways, the length of the longitudinal guideways being enough to enable such a displacement of the main shel(f/ves) that not only the extension shelf is cleared but also enough space is formed on either side of the extension shelf so as to allow grasping it, raising it to bring it at least at the level of the or both main shel(f/ves), but also displacing it slightly horizontally along the horizontal branch of the inverted L.

The document FR1568723 describes a rectangular table, designed especially for kitchens, whose feet and frame are metallic and the work plane made of Formica veneer wood. The work plane is constituted by a fixed portion and two extensions. In the closure position of the table, these are accommodated under the fixed portion, and in the opening position of the table, are deployed on either side of the fixed portion by means of carrier rails so as to lie at the same level as the fixed portion.

All these tables with extension are not suited to be used outdoors. Indeed, outdoor tables shall resist rain in particular such that said tables are either metallic or made of plastic. Moreover, composite materials suited to outdoor conditions such as HPL compact laminate commercialized by the company POLYREY have been developed and used to make outdoor tables with a fixed tray. Nevertheless, this type of materials has the drawback of deforming because of humidity so that trays made of this material for an outdoor table with an extension would have upper surfaces that are not flush with one another making such an outdoor table aesthetically unpleasant.

SUMMARY

Hence, the disclosure overcomes these drawbacks by providing a table with central extension having a simple and inexpensive design, wherein the extension(s) are removable and assembled such that the tray is perfectly aligned including when the extension(s) or the movable trays are deformed.

To this end, and in accordance with the disclosure, there is provided a table with central extension, comprising a frame, two movable trays bearing on said frame and adapted to be brought close to one another so as to constitute a continuous surface on their own, or to be symmetrically brought away from each other, or independently of each other so as to enable the set-up of one or several so-called central extension(s) between said movable trays, said table is remarkable in that the edges of the movable trays and of said extension(s) include at least one tab located on a first half of said edge and a groove located on a second half of said edge, said tab having a height increasing from its distal edge up to its central portion and decreasing from its central portion up to its proximal edge, and the depth of the groove being larger than the height of the tab, even when the trays and/or the extension are deformed.

Such a configuration of the tab ensures, during an approach of the two movable trays after positioning of at least one extension between the two movable trays, a progressive introduction of the tab into the corresponding groove. Thus, when the extension, positioned between the two movable trays, has, for example, a concavity or a convexity, the tab ensures a progressive deformation (and more precisely a progressive rectify) of the extension with the introduction of the tab into the corresponding groove, and therefore the obtainment of a planar upper surface.

Such a configuration of the tab also ensures, during an approach of the two movable trays in the absence of at least one extension between the two movable trays, a progressive introduction of the tab provided on a first one of the two movable trays into the groove provided on a second one of the two movable trays and a progressive introduction of the tab provided on the second movable tray into the groove provided on the first movable tray, and thus an assembly of the two movable trays and the obtainment of a planar upper surface.

According to an embodiment of the disclosure, the tab has a length comprised between 30 and 50% of the length of the respective edge, and for example between 40 and 50% of the length of the respective edge.

According to an embodiment of the disclosure, the tab includes:

a first tab portion which extends from the distal edge of the tab and which has a length comprised between 30 and 50%, and for example between 40 and 50%, of the total length of the tab, the first tab portion having a height increasing from the distal edge of the tab up to the central portion of the tab, and a second tab portion which extends up to the proximal edge of the tab and which has a length comprised between 30 and 50%, and for example between 40 and 50%, of the total length of the tab, the second tab portion having a height decreasing from the central portion of the tab up to the proximal edge of the tab.

According to an embodiment of the disclosure, the central portion of the tab has a length smaller than 20%, and preferably smaller than 10%, of the total length of the tab.

According to another embodiment of the disclosure, the central portion of the tab is located in a plane that is perpendicular to the direction of extension of the tab and which is located equidistantly from the distal and proximal edges of the tab. In other words, the central portion is located at the middle of the length of the tab, that is to say at the center of the tab. According to such an embodiment of the disclosure, the first tab portion extends up to the second tab portion.

According to an embodiment of the disclosure, the ridges of the tab are beveled and/or rounded.

According to an embodiment of the disclosure, the tab includes a recess opening into a top surface of the tab. The presence of such a recess ensures an optimum centering of the extension(s) with respect to the movable trays.

According to an embodiment of the disclosure, the recess is provided in the central portion of the tab.

According to an embodiment of the disclosure, the recess is located between, that is to say is configured to separate, the first and second tab portions.

According to an embodiment of the disclosure, the first tab portion has a height increasing from the distal edge of the tab up to the recess, and the second tab portion has a height decreasing from the recess up to the proximal edge of the tab.

According to an embodiment of the disclosure, the recess is provided in the second tab portion.

According to an embodiment of the disclosure, said recess has a trapezoidal general shape or a V-like general shape.

According to an embodiment of the disclosure, each extension includes on a first edge a tab and a groove and on its opposite edge a groove extending opposite the tab of the first edge and a tab extending opposite the groove of the first edge.

According to an embodiment of the disclosure, said movable trays and the extension(s) are made of HPL compact laminate or any other equivalent composite material, and preferably have a thickness comprised between 8 and 20 mm.

According to an embodiment of the disclosure, the tabs and/or the grooves are obtained in the mass of the movable trays and/or of the extension(s) or are attached.

BRIEF DESCRIPTION OF THE DRAWINGS

Other advantages and features will appear better from the following description of one single variant, provided as a non-limiting example, of the table with an extension in accordance with the disclosure, with reference to the appended drawings wherein:

FIG. 1 is a perspective view of the table with central extension according to the disclosure, FIG. 2 is a side view of the table with central extension according to the disclosure, FIG. 3 is a top view of the frame of the table with central extension according to the disclosure, FIG. 4 is a top view of a central extension of the table according to the disclosure, FIG. 5 is a top view of the tab of a central extension of the table according to the disclosure, FIG. 6 is a side view of the edge of a central extension of the table according to the disclosure, FIG. 7 is a sectional view of the groove-tab assembly between a central extension and a movable tray of the table according to the disclosure.

DETAILED DESCRIPTION OF THE DRAWINGS

In the following description of the table with an extension according to the disclosure, the same reference numerals refer to the same elements. The different views are not necessarily plotted to the scale.

Referring to FIGS. 1 to 7, the table with central extension 1 according to the disclosure, comprises a frame 2, two movable trays 3, 4 bearing on said frame 2 and adapted to be brought close to one another so as to constitute a continuous surface on their own, or to be symmetrically brought away from each other, or independently of each other so as to enable the set-up of one or several so-called central extension(s) 5 between said movable trays 3, 4.

In this particular example, referring to FIGS. 1 to 3, the frame 2 is constituted by a rectangular metallic frame 6, preferably made of aluminum, constituted by two spars 7 and two crosspieces 8 and at the angles of which feet 9 are secured, made of aluminum or of a rigid plastic material, said feet 9 being preferably inclined. The two spars 7 respectively comprise a coulisse 10 allowing increasing the dimensions of the frame 6, and inversely reduce the dimensions of the frame 6, for the set-up and respectively the removal of a central extension 5 between the movable trays 3, 4 which are secured to the frame 6 of each side of the coulisses 10.

It is obvious that the frame 2 could have any shape and any structure yet without departing from the scope of the disclosure. Moreover, in this particular embodiment, the movable trays 3, 4 and the central extension 5 have a substantially rectangular shape. Nonetheless, it is obvious that the movable trays 3, 4 and the central extension 5 could have any shape yet without departing from the scope of the disclosure.

Referring to FIGS. 4 to 7, the edges 11 of the movable trays 3, 4 and of the central extension 5 include a tab 12 located on a first half of said edge 11 and a groove 13 located on a second half of said edge 11, said tab 12 having a height increasing from its distal edge up to its central portion and decreasing from its central portion up to its proximal edge, and the depth of the groove 13 being larger than the height of the tab 12.

Advantageously, the tab 12 has a length comprised between 40 and 50% of the length of the respective edge 11, and for example about 50%, and advantageously includes:

a first tab portion 12.1 which extends from the distal edge of the tab 12 and which has a length comprised between 30 and 50%, and for example between 40 and 50%, of the total length of the tab 12, the first tab portion 12.1 having a height increasing from the distal edge of the tab up to the central portion of the tab, and a second tab portion 12.2 which extends up to the proximal edge of the tab 12 and which has a length comprised between 30 and 50%, and for example between 40 and 50%, of the total length of the tab 12, the second tab portion 12.2 having a height decreasing from the central portion of the tab up to the proximal edge of the tab.

Advantageously, the groove 13 includes:

a first groove portion 13.1 configured to receive the first tab portion 12.1, and a second groove portion 13.2 configured to receive the second tab portion 12.2.

Depending on the dimensions of the central extension 5 and of the movable trays 3, 4, the edges 11 may include several tabs 12 and several grooves 13 yet without departing from the scope of the disclosure.

In this particular example, the increasing portion and the decreasing portion of the tab 12 have the shape of a second-order polynomial curve.

Referring to FIGS. 4 and 6, each extension includes on a first edge 11 a tab 12 and a groove 13 and on its opposite edge 11 a groove 13 extending opposite the tab 12 of the first edge 11 and a tab 12 extending opposite the groove 13 of the first edge.

Moreover, referring to FIGS. 4 and 5, the tab 12 includes in its central portion a recess 14 which opens into a top surface of the tab 12 and which is located between, that is to say configured to separate, the first and second tab portions 12.1, 12.2. Thus, the first tab portion 12.1 has a height increasing from the distal edge of the tab 12 up to the recess 14, and the second tab portion 12.2 has a height decreasing from the recess 14 up to the proximal edge of the tab 12.

According to a variant that is not represented in the figures, the recess 14 could however be provided in the second tab portion 12.2.

In this particular embodiment, said recess 14 has a trapezoidal general shape; nonetheless, it is obvious that said recess 14 could have a V-like general shape yet without departing from the scope of the disclosure.

In addition, in a common manner, with reference to FIG. 7, the ridges of the tab 12 are beveled and/or rounded.

Incidentally, the movable trays 3, 4 and the extension(s) 5 are made of HPL compact laminate, commercialized for example by the company POLYREY, or of any other equivalent composite material, and have a thickness comprised between 8 and 20 mm.

The tabs 12 and the grooves 13 of the extension 5 and of the movable trays 3, 4 enable assembly by mortise-and-tenon joint of the movable trays 3, 4 together or of the movable trays 3, 4 with the central extension 5 which confers a larger surface of the planar tray despite the possible deformations of the movable trays 3, 4 and/or of the extension 5, the movable trays 3, 4 and/or the extension 5 being perfectly aligned, i.e. coplanar with one another, even when the trays 3, 4 and/or the extension (5) are deformed.

It is obvious that the tabs 12 and/or the grooves 13 are obtained in the mass of the movable trays 3, 4 and/or of the extension(s) 5, or are attached yet departing from the scope of the disclosure.

Finally, it is obvious that the examples that have just been given are only but particular illustrations that do not limit in any manner whatsoever the fields of application of the disclosure.

The invention claimed is:

1. A table with central extension, comprising a frame, two movable trays bearing on said frame and adapted to be brought close to one another so as to constitute a continuous surface on their own, or to be symmetrically brought away from each other, or independently of each other so as to enable the set-up of one or several central extension(s) between said movable trays, wherein edges of the movable trays and of said extension(s) include at least one tab located on a first half of said edge and a groove located on a second half of said edge, said tab including a first tab portion extending from a distal edge of the tab and having a length comprised between 30% and 50% of the total length of the tab and a second tab portion extending up to a proximal edge of the tab and having a length comprised between 30% and 50% of the total length of the tab, the first tab portion having a height increasing from the distal edge of the tab up to a central portion of the tab and the second tab portion having a height decreasing from the central portion of the tab up to the proximal edge of the tab, said tab having a length comprised between 30% and 50% of the length of the respective edge, and the depth of the groove being larger than the height of the tab, enabling an assembly by mortise-and-tenon joint even when the trays and/or the extension are deformed.

2. The table with central extension according to claim 1, wherein the tab includes ridges which are beveled.

3. The table with central extension according to claim 1, wherein the tab includes a recess in the central portion.

4. The table with central extension according to claim 3, wherein said recess has a trapezoidal general shape.

5. The table with central extension according to claim 1, wherein each extension includes, on a first edge, a tab and a groove and, on the opposite edge, a groove extending opposite the tab of the first edge and a tab extending opposite the groove of the first edge.

6. The table with central extension according to claim 1, wherein the movable trays and the extension(s) are made of HPL compact laminate.

7. The table with central extension according to claim 1, wherein the movable trays and the extension(s) have a thickness comprised between 8 mm and 20 mm.

8. The table with central extension according to claim 1, wherein the tabs and/or the grooves are machined on the movable trays and/or on the extension(s), or are attached to the movable trays and/or to the extension(s).

* * * * *